United States Patent [19]

von Schuckmann

[11] Patent Number: 4,732,549

[45] Date of Patent: Mar. 22, 1988

[54] DOSAGING PUMP WITH PUMP BELLOWS ON BOTTLES OR THE LIKE

[75] Inventor: Alfred von Schuckmann, Kervendonk, Fed. Rep. of Germany

[73] Assignee: Mega Product- und Verpackungsentwicklung Marketing GmbH & Co. Kommanditgesellschaft, Wuppertal, Fed. Rep. of Germany

[21] Appl. No.: 836,937

[22] Filed: Mar. 6, 1986

[30] Foreign Application Priority Data

Mar. 14, 1985 [DE] Fed. Rep. of Germany ..... 3509178
Jun. 15, 1985 [DE] Fed. Rep. of Germany ..... 3521611
Jan. 9, 1986 [DE] Fed. Rep. of Germany ..... 3600356

[51] Int. Cl.[4] ..... F04B 43/00; F04B 21/04; B67D 5/42; B65D 88/54

[52] U.S. Cl. ..... 417/472; 417/552; 92/47; 222/153; 222/207; 222/211; 222/321

[58] Field of Search ..... 417/472, 550, 552, 554; 92/34, 47; 222/153, 207, 211, 212, 321

[56] References Cited

U.S. PATENT DOCUMENTS

| | | | |
|---|---|---|---|
| 862,867 | 8/1907 | Eggleston | 417/390 |
| 1,029,496 | 6/1912 | Garlock | 417/472 |
| 2,095,622 | 10/1937 | Wilson | 222/321 |
| 2,686,006 | 8/1954 | Hasselquist | 92/47 X |
| 3,161,329 | 12/1964 | Fedit et al. | 222/321 |
| 4,336,895 | 6/1982 | Aleff | 222/207 |
| 4,410,107 | 10/1983 | Corsette | 222/321 |
| 4,589,573 | 5/1986 | Tada | 222/153 |

FOREIGN PATENT DOCUMENTS

| | | | |
|---|---|---|---|
| 1254970 | 11/1967 | Fed. Rep. of Germany | 417/550 |
| 1459735 | 10/1966 | France | 222/207 |
| 2042630 | 11/1980 | United Kingdom | 417/552 |

*Primary Examiner*—Carlton R. Croyle
*Assistant Examiner*—Paul F. Neils
*Attorney, Agent, or Firm*—Martin A. Farber

[57] ABSTRACT

A dosaging pump which can be placed, in particular, on bottles or the like, having a pump bellows and two valves, one of which is associated with the inlet side and the other with a nozzle. The nozzle-side valve-closure member is seated in the cover of a cap which grips over the pump bellows and the side wall of which is guided on the wall of a cup which surrounds the pump bellows, the inlet-side valve-closure member being seated in the bottom of the cup which is formed with an air-inlet opening. End folds of the pump bellows are seated on separate collars of the cup and the cap, and the end folds extend into outwardly directed protruding base support rings. A cup-bottom side of the base support rings has a sealing lip extending over the air-inlet opening in the cup bottom and the lip has a free-standing lip section resting against an inner wall of the cup.

12 Claims, 12 Drawing Figures

DOSAGING PUMP WITH PUMP BELLOWS ON BOTTLES OR THE LIKE

FIELD AND BACKGROUND OF THE INVENTION

The present invention refers to a dosaging pump which can be placed, in particular, on bottles or the like. In particular the dosaging pump of the invention has a pump bellows and two valves.

Dosaging pumps with free-standing pump bellows are known. The pump bellows must be exceptionally stable and therefore have thick walls. This means an expense for material and results in more difficult operation, particularly for children and older people. On the other hand, there are pump pistons with structural parts which are guided on one another.

SUMMARY OF THE INVENTION

The object of the present invention is to develop a dosaging pump of this type in a form which is stable in use and simple to manufacture and assemble and in such a manner that the stability of the guidance is obtained by means of parts of the dosaging pump which are already present.

According to the present invention the nozzle-side valve-closure member is seated in the cover of a cap which grips over the pump bellows, the side wall of said cap being guided on the wall of a cup which surrounds the pump bellows, and within the bottom of which cup an inlet-side valve-closure member is seated. The end folds of the pump bellows are seated on separate collars and continue into outwardly directed protruding base support rings, and the cup-bottom side base support ring extends in the manner of a sealing lip over an air-inlet opening in the cup bottom and rests with a free-standing lip section against the inner wall of the cup.

As a result of this development there is created a pump of the introductory mentioned type which is characterized by a simple construction which is stable in use. The pump bellows, which can be made with relatively thin walls, is simply inserted freely between two structural parts of the pump housing which are guided on each other. No tilting of the pump bellows and resultant displacement of the nozzle thus impairing the target accuracy of the delivery occur any longer. The pump bellows itself forms the return spring. Specifically, the nozzle-side valve-closure member seats in the cover of a cap which grips over the pump bellows and the side wall of which is guided on the wall of a cup which surrounds the pump bellows and within the bottom of which the inlet-side valve closure member sits. In this connection it is favorable for the inner surface of the side wall to be guided on the wall formed by the cylindrical surface of the cup. Furthermore, it has been found advantageous, from the standpoint of coordination of the parts, that a screw-on part of the dosaging pump is present on the underside of the cup bottom and that a riser connecting nipple with the valve-closure member arranged in it lie centrally therein. The screw-on part furthermore results in a lengthened guide surface for the axially displaceable cap. For the fixing of the pump bellows it is favorable for the end folds of the pump bellows to sit on collars and to be continued by outwardly-directed projecting base support rings; by means of the enlarged support-ring surface obtained in this manner, the base support ring on the bottom side of the cup fulfills still another function insofar as it extends in sealing lip fashion over an air-inlet opening in the bottom of the cup and in addition rests via a free-standing section of the lip against the inner wall of the cup. The lip section acts like a valve so that an acute-angle application is effected. Upon the suction stroke of the pump bellows the lip section lifts off from the cup wall so that equalization of the air can take place via the joint between the pump housing parts which guide each other. At least the nozzle-side valve-closure member has spring tongues which protrude in horn-shaped manner and rest against the bottom of an actuating surface of the cap, which actuating surface is arranged with axial spacing above the cover of the cap. This may be an insert part which is held by a clip-type attachment. In order to secure the position of the other valve member, the upper edge of the connecting-nipple hole which receives the bottom-side valve-closure member has holding projections associated with it for retaining said valve-closure member. In this way, the displacement of the valve-closure member into its open position is limited by simple means. In order to achieve a compact form of the dosaging pump, it is advantageous for the cup bottom-side base-support ring to terminate at an axial distance in front of the air-inlet opening. The invention also proposes that the pump bellows be developed as a threaded bellows. This bellows can, accordingly, be produced as a precision part, as is not possible, for example, by a blow-molding process. Furthermore it is also not necessary to operate with a mold core which breaks apart; furthermore, the mold core can be simply screwed out. Furthermore, by twisting the two pump parts relative to each other it is possible by simple means to obtain an effective lock. Thus, accidental contact cannot lead to the dispensing of the filling content. For this, it is necessary intentionally to bring the cup and the cap into proper pumping alignment. In this connection, it is favorable for purposes of guidance and at the same time in order to obtain a better grip for attaching the cup to the neck of the bottle or the like that the outer cylindrical surface of the cup be provided on its entire circumference with grooves and ribs which are uniformly spaced apart and only a fraction of which are open at the top in longitudinal direction, namely those which lie in front of the ribs of the cap in a turn-stop position. Furthermore, it is advantageous for the turn-stop position to be formed by projections on the cup which strike against the side flanks of the ribs of the cap. These ribs, to this extent, even have an additional function; they form, namely, the counterstop for the projections, which projections can be produced simulataneously during injection molding of the cup. In order to hold the pump bellows in its proper operating position so that the twisting of cup and cap does not lead to a wringing off of the pump bellows, a central nipple of the cap which receives the valve member merely engages turnably into a collar on the pump bellows. An advantageous development is furthermore realized by a plurality of pairs of ribs arranged with angular symmetry on the inner surface of the cap. The stop action is thus distributed over a correspondingly large number of surfaces. This has the advantage that a very slight height of rib is sufficient. With reference to the mounting of the pump and its coordination with the bottle or the like, one advantageous further development is that the cap is guided on the inner wall of the cup, the side wall is continued by fingers which pass through slots in the bottom of the cup and grip below it and, upon the movement of the pump, enter into a free space formed between cup wall and bottle neck, below which free space the cup is fastened towards the bottle neck. The anchoring-like connection zone of the pump parts thus extends outside the neck of the bottle and is reached simply via fingers of the cap which pass through slots in the bottom. These fingers, as a result of the guided coordination of the cap on the inner wall of the cup have a correspondingly precise alignment so that an accurate bottom-side underengagement is always present. When they have come into the anchoring position the fingers secure the pump unit containing the fittings such as the bellows, valve members, etc., of which fittings the bellows, acting at the same time as a spring member, in this case also pushes the cap back into the pump-ready position. The space for receiving the fingers upon pump movement is arranged favorably from a space standpoint between the cup wall and the neck of the bottle. The fastening place between bottle neck and cup of the dosaging pump is located at the lower end of the free space. The free space is advantageously formed by reduction of the cross section of the neck of the bottle at its upper end. The cup can in this way continue without interruption downwardly beyond the section thereof forming the guide, so that a constant gripping region for the holding hand is present. Furthermore, it is advantageous for the radially outwardly springable fingers to engage below the bottom by radially inwardly directed detent projections. The space to receive the fingers which spring out upon the mounting is obtained in simple manner by a radially inwardly directed offset of these fingers with respect to the guided outer wall of the cap or by cutting from the back of the fingers. The lock can be reversible or irreversible. For one-way pumps, preference would be given to a non-reversible assembly. Instead of direct underengagement of the detent projections, the fingers can engage below a sealing ring which lies between the bottom and the rim of the bottle neck. For the definition of the pump-ready position as compared with a locking position, it is furthermore advantageous for a radially outwardly-directed snout-shaped nozzle of the cap which is turnable with respect to the cup to lie, in the pump-ready position, above an entry notch in the cup wall. If the nozzle is not in congruent alignment with the entry notch then the cap is not axially displaceable for carrying out the pumping movement. If preference is given to a locking device which is completely invisible and in which therefore no entry notch is to be formed on the cup, for example for esthetic considerations, then simply from the lower edge of the side wall of the cap which is turnable with respect to the cup, a locking being located, in the pump-ready position, above an opening in the bottom and in its locking position striking against the bottom. As an advantageous further development, the locking projection is, however formed by a widening in the region of attachment of the finger and the opening is formed by a partial section of the slot. Finally, the invention also provides as a further feature that a forked annular lip section of the pump bellows lie within an annular groove of the bottom of the cup, from which the air inlet opening extends through the bottom. In this way, the corresponding valve function is optimized.

BRIEF DESCRIPTION OF THE DRAWINGS

With the above and other objects and advantages in view, the present invention will become more clearly understood in connection with the detailed description of preferred embodiments, when considered with the accompanying drawings, of which.

DETAILED DESCRIPITON OF THE PREFERRED EMBODIMENTS

The dosaging pump 1 is, in accordance with the first embodiment, screwed onto the neck of a bottle 3. The outer thread thereof bears the reference number 4. The inner thread which can be brought into engagement therewith is designated 5.

Figure 10:
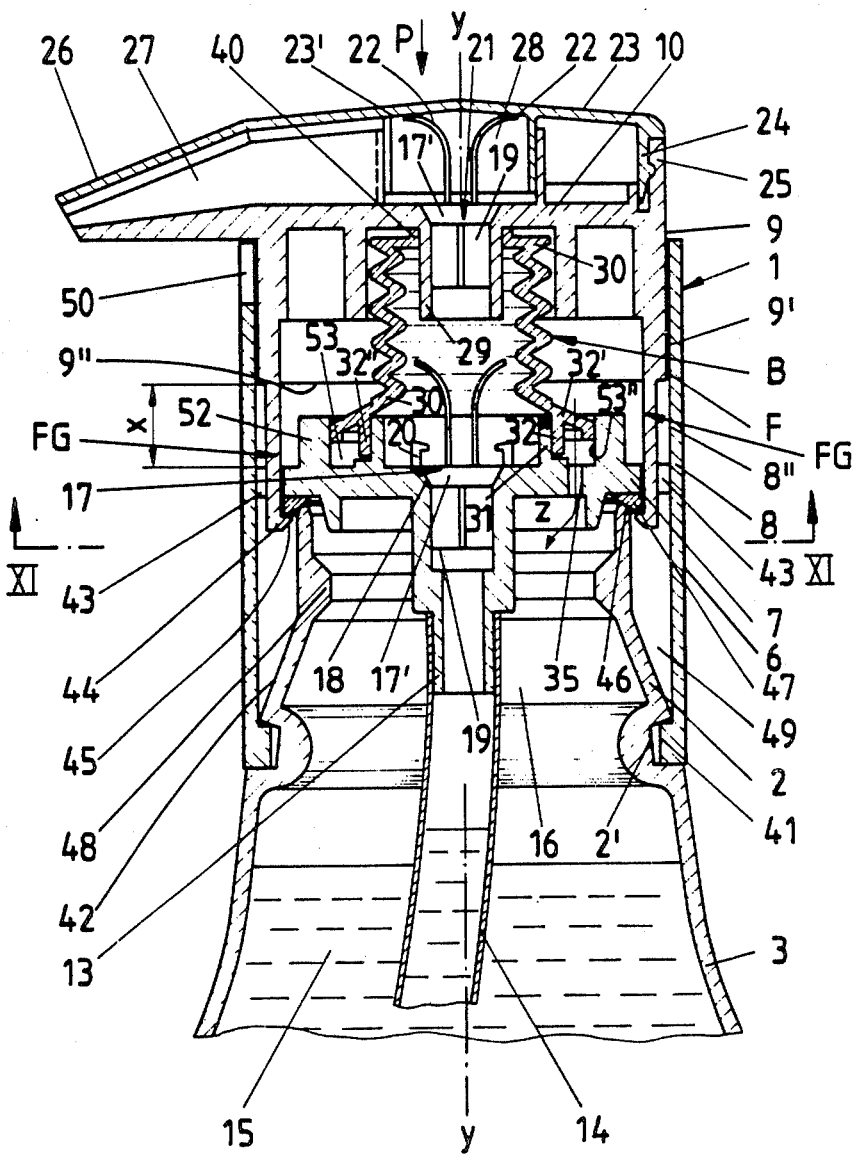
FIG. 10 is a section along the line X—X of FIG. 9, on a larger scale than in FIG. 9.

The attachment of the dosaging pump in the second embodiment is effected by clipping. For this purpose the neck has an annular groove 2' (FIG. 10). Into it there engages an annular rib 41 of the pump body. To facilitate the entrance of the annular rib, a run-on bevel 42 which is formed by a frustoconical section of the wall of the neck 2 is arranged in front of the annular groove 2'.

The screw-on or attachment part 6 of the dosaging pump 1 attaches below the horizontal bottom 7 of a cup 8. The latter has its opening facing upward.

The cup 8 receives a pump bellows B concentrically mounted therein. The pump bellows is gripped over on top by a cap 9 which, in accordance with the first embodiment, travels on the cup 8. The upper end of the pump bellows B rests against the cover 10 of the cap 9. In the basic position (FIG. 1) of the dosaging pump, the edge 8' of the cup 8 is at a distance x from the bottom of the cover 10 which, in the depressed position (see FIG. 2), forms indirectly the stroke-limiting stop for the cap 9 which is displaceable against spring action in the direction towards the standing surface of the bottle. The inner surface 9' of said cap is guided on the wall 8'' formed by the outer surface of the cup 8. The return spring is formed by the pump bellows B itself.

The basic position of the dosaging pump is defined by a stop. For this purpose, the cap 9 forms at its lower edge an inwardly-directed annular collar 11. The latter snaps behind a cup-side shoulder 12 at the level of the bottom 7 of the cup 8. The lower section of the cup, which forms the screw-on part 6, is reduced slightly inwardly in cross section. Its cylindrical outer surface has an axial length that corresponds at least to the distance x so that the outer surface is available as an additional guide surface for the cap 9.

In accordance with the second embodiment of FIGS. 8–12, the cap 9 is guided within the cup 8. In the pump-ready position of the dosaging pump 1, the edge 9″ of the cap 9 is at a distance x from the top side of the bottom 7 of the cup 8. This distance corresponds to the actuating stroke, so that the limitation for the cap 9, which is displaceable against spring action in the direction towards the standing surface of the bottle, results from this. The wall surface 9′ of the cap is guided on the inner surface 8‴ of the cup 8. The return spring (action) is formed by the pump bellows B itself. The basic position of the dosaging pump 1, which position at the same time forms the pump-ready position, is also defined by a stop. For this purpose fingers FG extend from the cylindrical side wall of the cap 9 which is guided in the cup 8. Referring to FIG. 10, the fingers extend from the edge 9″ of the cap 9 and are continued in the lengthwise direction of the side wall of the cap 9, namely in the direction towards the standing surface of the bottle and in the direction of the bottom 7, through which they pass. For this purpose the bottom 7 has slots 43 below whose lower inner edge the fingers FG grip, directly or indirectly, in the basic position. The restoring force of the bellows B holds the detent projections 44, directed radially inwards on the fingers FG, in an applied position. So that the fingers FG or their free ends bearing the detent projections 44 can travel, upon movement of the detent, over the outwardly pointing inner flank of the slots 43 with sufficient space into which they can move back, the slots 43 have a radial width which corresponds to the detent head, i.e. they spring back with respect to the inner wall of the cylindrical cup 8 by an amount equal to the detent projection. The back of the projection of each finger FG has a run-on bevel 45 so that the detent projections 44 can, upon assembly, be forced more easily out of their axial position in order then to catch below the corresponding slot edge.

As can be noted from FIG. 10, a sealing ring 47 is interposed between the lower side of the bottom 7 and the rim 46 of the bottle neck. Said sealing ring is of triangular cross section. The longer side of the triangle forms a flatly conical sealing flank which extends outward, however, beyond the cylindrical section of reduced cross section adjoining the run-on bevel 42 so that the necessary possibility of gripping under by the detent projections 44 is present. The rim 46 converges upwardly on both sides. The upper region of the bottle neck 2 close to the rim is developed with a thinner wall than the lower region. Between the latter and the wall section forming the run-on bevel 42 of the bottle neck 2 there is an inwardly-directed bead-like thickening 48. The latter, together with the inwardly arched edge portion forming the annular groove 2′, stiffens the entire section of the neck.

Upon actuation of the pump, which is effected by pressing the cap 9 downwards, the detent projections 44 lift off from the lower side of the bottom 7 and the sealing ring 47; they move into an annular free space 49 extending concentrically around the longitudinal central axis y-y of the pump body 1, said space being formed between the cup wall in the region of the attachment part 6 and bottle neck 2. The axial length of said space is so dimensioned that the fingers FG can freely move into it. The fastening point between the bottle neck 2 and the cup 8 is namely still at a sufficient distance below the required path of the actuating stroke. The free space 49 is formed by the reduction in cross section of the bottle neck 2 in the region of its upper end.

In both embodiments, the bottom 7 forms, a centrally, arranged nipple 13 for the attachment of a riser 14. The latter extends up to shortly in front of the bottom of the bottle 3 and therefore dips over its entire length into the fluid medium 15 which is to be dispensed in dosaged amount. The connecting tube 13 has a diameter which still leaves sufficient annular space between its outer wall, which is slightly stepped down in the central region, and the bottle mouth 16 into which the nipple 13 therefore extends freely.

The upper, somewhat wider half of the nipple 13 contains a valve-closure member 17 guided axially therein. Its upper, flatly frustoconical disk 17′ comes in closing position against a valve-seat surface 18 of the passage hole in the bottom 7. Adjoining the edge of the disk which applies itself in sealing fashion, the flatly frustoconical section of the plate 17′ is set back from the inner wall of the connecting tube and is continued by a valve-closure-member guide shaft 19 of x-shaped profile.

As can be noted from the drawing, retaining projections 20 extend from the upper edge of the nipple hole which receives the bottom-side valve-closure member 17 in order to retain the valve-closure member 17, which thus has limited axial displaceability. The retaining projections 20 are developed directly on the bottom 7. In general, two diametrically opposite retaining projections are sufficient. However, three retaining projections 20 arranged spaced an equal angle apart are preferable. The vertical shank of the projections deflect upon the clip in attachment of the valve-closure member 17.

Figure 2:
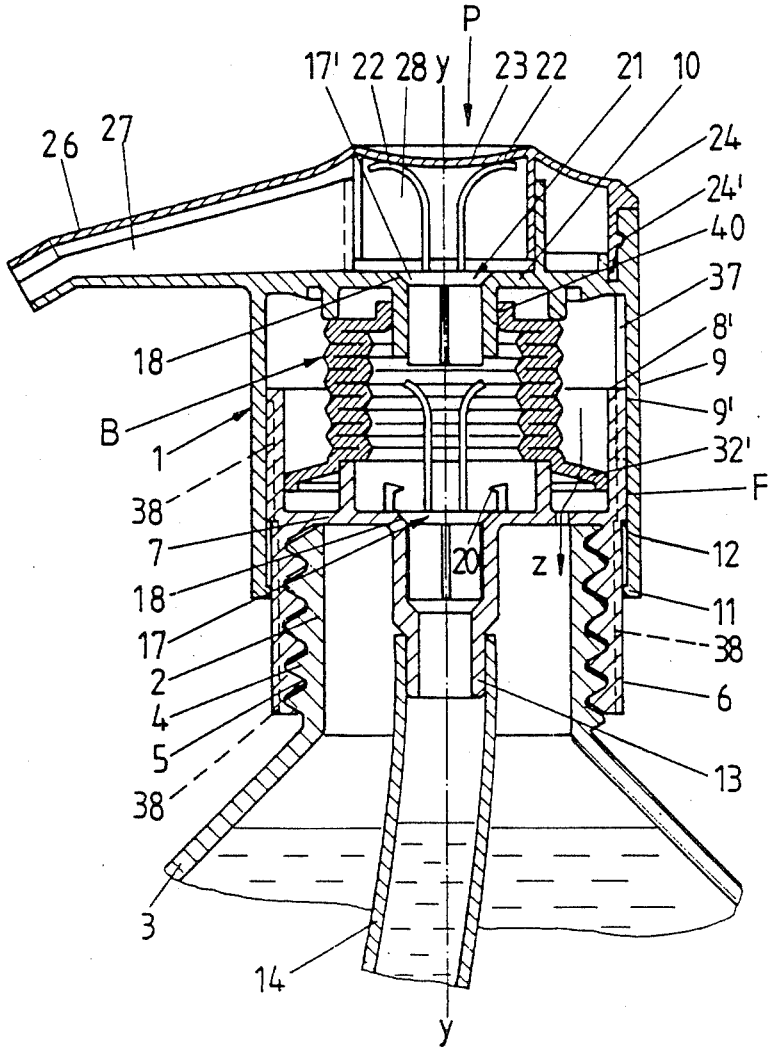
FIG. 2 is a view corresponding to FIG. 1 but in the pump actuating position and therefore with the pump bellows compressed.

The second of the two valve-closure members 21 which are arranged in the region of the ends of the pump bellows B is located in the cover 10 of the cap 9. It is of the same construction as the valve-closure member 17, for which reason the same reference numbers are applied analogously without repetition of detailed explanation herein. The only difference is that this upper member 17 is not held in its closed position by gravity but is spring loaded in that direction. For this purpose, two spring tongues 22 extend from the top of the plate. These tongues are of horn shape, i.e. they diverge and pass at their ends into an outwardly-directed rounding. These rounded end sections come against the bottom side 23′ of an actuating surface 23 of the cap 9. The actuating surface 23 which, as shown in FIG. 2, is dented-in from the top extends with axial clearance over the cover 10 of the cap 9. The actuating surface 23 is formed by the bottom part of a cup-shaped push-in part 24 which is clipped in cover-like manner in an extension 25 of the cap 9. The clip zone bears the reference number 24′. An irreversible (non-releasable) clip arrangement is preferably employed. The collar-like extension 25 of the cap 9, which is correspondingly open on top, forms, together with the push-in part 24, directed transversely radially outward, a snout-shaped nozzle 26 whose channel 27 is in fluid communication with a chamber 28 developed in the region of the extension 25.

In order to receive the nozzle-side valve-closure member 21, the cover 10 forms a nipple 29 which extends into the inside of the pump bellows B. The nipple has an axial length such that in the pump-actuating position it still remains at a sufficient distance from the retaining projections 20 (see FIG. 2).

For supporting and also at the same time for sealing and fixing in position the pump bellows B on the cup 8, the end folds 30 of the pump bellows B are seated on a corresponding collar 31 of the bottom 7 and the cover 10 respectively (FIG. 10). The two collars 31 extend concentrically to the longitudinal central axis y—y of the dosaging pump. The end folds 30 of both ends then continue into base support rings 32. On the side of the cup bottom the base support ring 32 has a further function. It namely extends over one or more air-inlet openings 35 in the bottom 7 of the cup 8. It exercises a sealing-lip function and for this purpose its free-standing lip section 32' lies resiliently against the corresponding cup inner wall 8'''. In order to replace the volumetric proportion of air corresponding to the dispensed quantity, the circumferential lip section 32' lifts off from the cup inner wall 8''' upon the suction stroke of the pump bellows so that, via the joint F between cup 8 and cap 9, air can enter the inside of the bottle in the direction indicated by the arrow z. In the basic position, on the other hand, the lip section 32' again comes into the sealing position shown in FIG. 1. Since the lip section 32' extends in an obliquely descending direction and upon compressing the pump bellows a tilting moment is produced in the direction towards the cup inner wall 8''' around the fold end point, the corresponding sealing application is also mechanically abetted, particularly as the pump bellows is also mounted with a slight initial stress. Such a valve function of the lip section 32' prevents fluid 15 from emerging or passing into the free annular space surrounding the pump bellows should the bottle fall over. As can be noted from FIG. 1, the lower edge of the end fold 30 there of the pump bellows B lifts off on top from the air inlet opening 35.

In accordance with the second embodiment, the collar 31, which is here provided only at the bottom, is surrounded concentrically by a second collar 52 which also extends from the top side of the bottom. Between the two collars 31, 52 there is an annular groove 53. Into the latter there extends a forked annular lip section of the pump bellows B. One ring lip section 32 surrounds in sealing fashion the outside of the cylindrical collar 31. The other circumferential lip section 32' provides the above-described sealing-lip or valve function. The same reference numbers are applied analogous.

Figure 1:
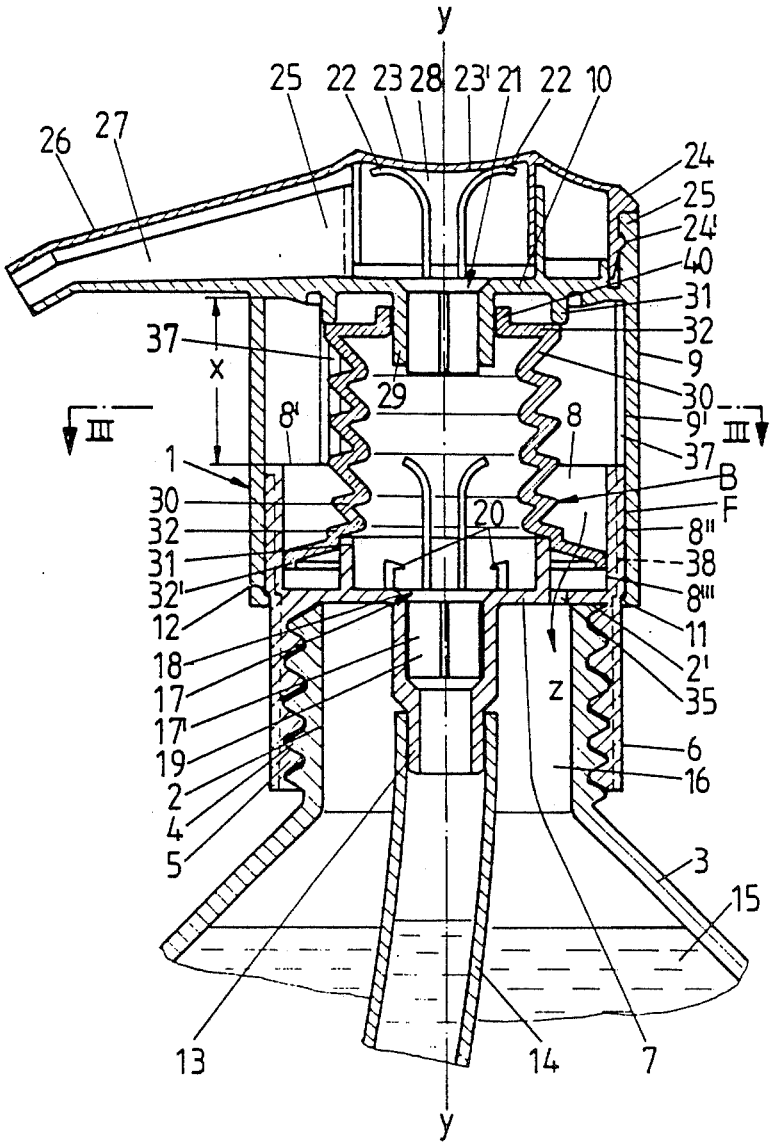
FIG. 1 shows, in vertical section, the first embodiment of the dosaging pump screwed onto a bottle neck, seen in its spring loaded basic position, unlocked.

Cup 8 and cap 9 of the dosaging pump are turnable relative to each other to a stop-limited extent in the expanded position of the pump bellows B, namely in the basic position shown in FIG. 1. The rotationally symmetrical construction of the pump-forming parts which is accordingly selected can be noted from FIGS. 3 and 4. By turning the two parts with respect to each other, the cap 9 is brought into an actuation-ready respectively or into a locked position. In this way, accidental contact with the cap or, for instance, the dropping of the bottle 3 on its head no longer leads to an unintended discharge. The turn-stops for both end positions are formed by projections 36. As can be clearly noted from FIGS. 5 to 9, the latter extend to the upper rim 8' of the cup 8. Their front edges in the direction of turning extend into the region of the ribs 37 of the cap 9 which form corresponding counterstops. Depending on the direction of turning they strike against one or the other outer side flanks of these ribs, which are arranged in pairs (see FIGS. 3 and 4).

The pairs of ribs extend with angular symmetry along the inner surface 9' of the cap 9. The angular spacing is 120°. Multiplication of the stops produces the advantage of a small rib height since the impact pressure is distributed over several surfaces. The cup and cap can therefore have very thin walls.

The ribs 37 extend in the axial direction of the dosaging pump and cooperate with correspondingly aligned grooves 38 on the corresponding cylindrical surface 8'' of the cup 8. The grooves 38, which are developed at least also in pairs, i.e. their entrance cross section for the ribs 37, are brought, by the relative turning of one or the other pump part, and therefore of the cup or of the cap 9, out of the congruent position so that the closed cup rim, and therefore the front surface 8' of the cup 8, extends instead of the groove 38 in front of the entrance side lower end 37' of the ribs 37.

Figure 7:
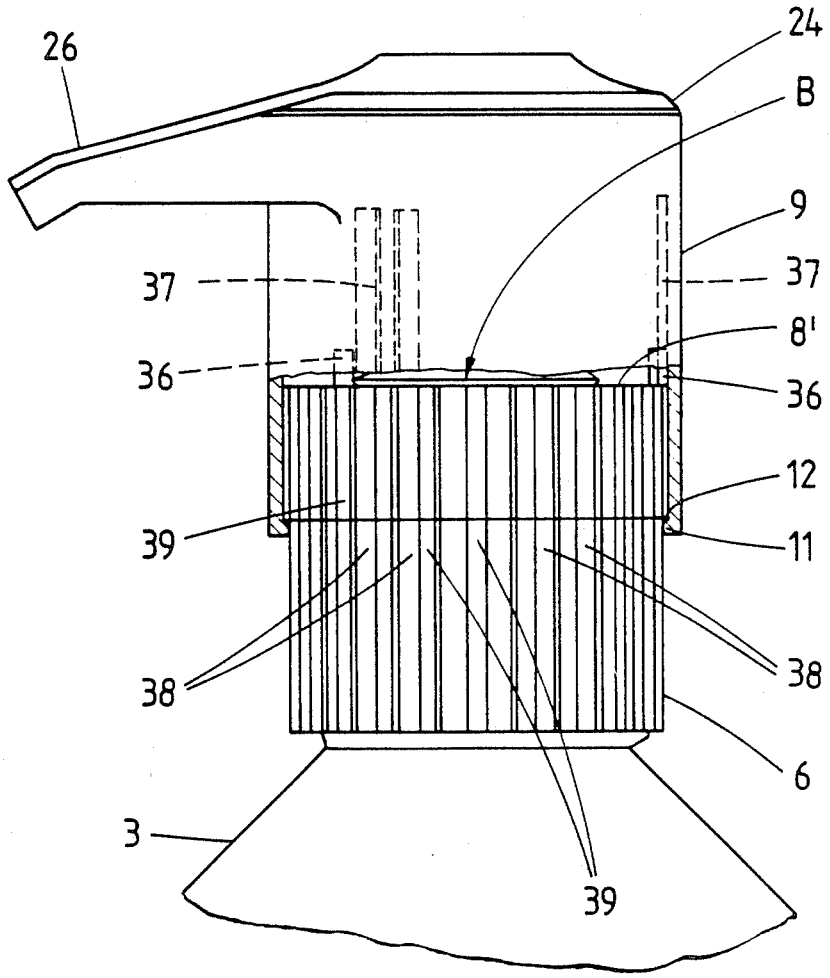
FIG. 7 is a fragmentary side view of the dosaging pump in the position shown in FIG. 1.
Figure 8:
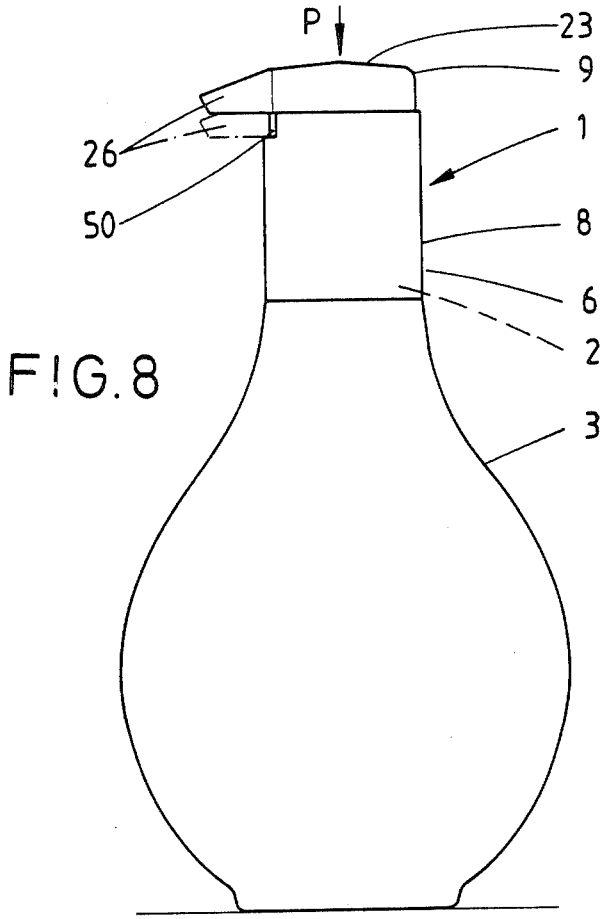
FIG. 8 shows the bottle of the invention with dosaging pump in accordance with the second embodiment seated thereon, seen in side view.
Figure 9:
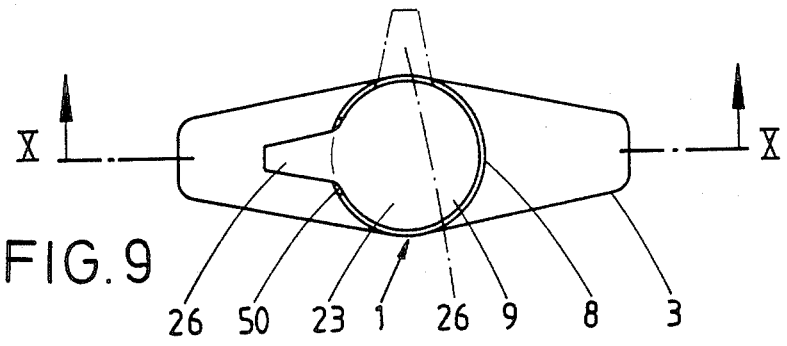
FIG. 9 is a top view thereof.

In the case of a continuously surrounding ribbing, such as can be noted from FIG. 7, the corresponding blocking when the cup edge is not pulled closed, can naturally also be assumed by the corresponding end surfaces of the ribs 39, left between the grooves 38, of the cylindrical surface of the cup 8 and of the downwardly adjoining screw-on part 6. The stop projections 36 must be arranged accordingly. The turning path must correspond at least to the inside width of a groove or a multiple of said width. By the corresponding ribbing of the cylindrical surface of the cup or of the screw-on part, there is obtained not only a better guidance of the two pump-forming parts which are turnable with respect to each other but also an improvement in gripping for the screwing on or off of the cup 8. Furthermore, the interengagement between the annular collar 11 of the cap 9 and the shoulder 12 of the cup 8 can be started more favorably. The step is less abrupt. The annular collar can also be formed by ribs of equal angular spacing which protrude in secant-like manner into the circular hollow of the cap 9.

Figure 3:
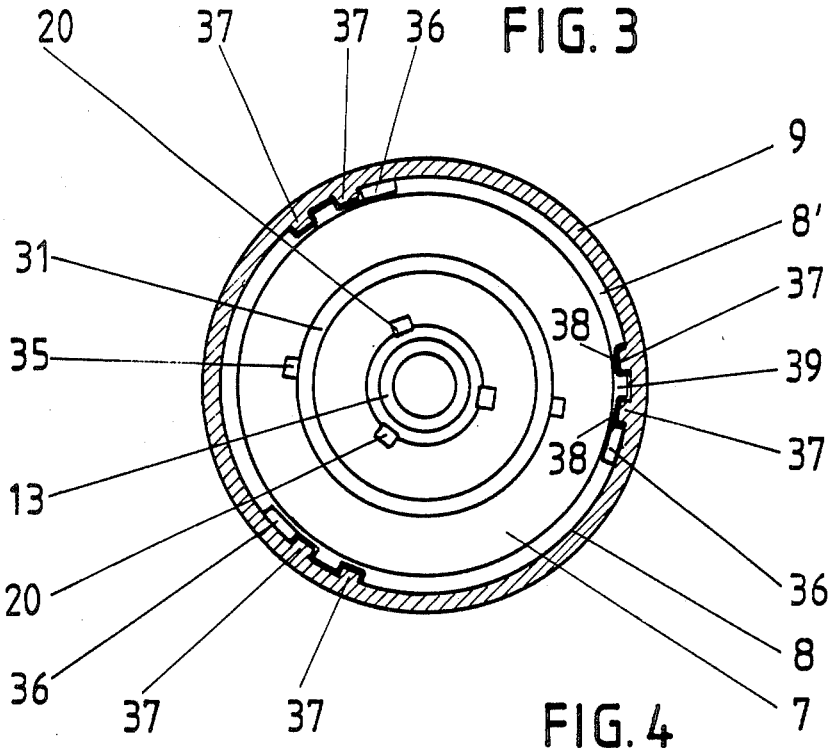
FIG. 3 is a section along the line III—III of FIG. 1, with the pump bellows removed.
Figure 4:
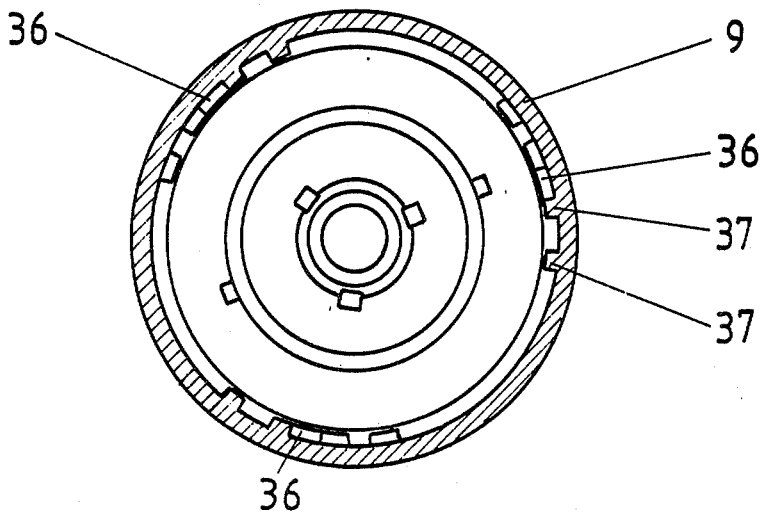
FIG. 4 is a sectional view corresponding to FIG. 3 but in the locked position.
Figure 5:
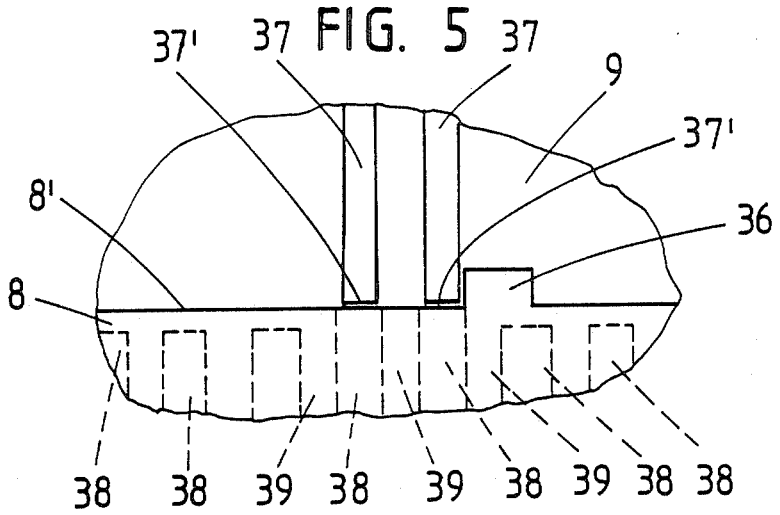
FIG. 5 is a view of the means which produce the locking position, shown on a larger scale, in the actuation-ready position of the cap.
Figure 6:
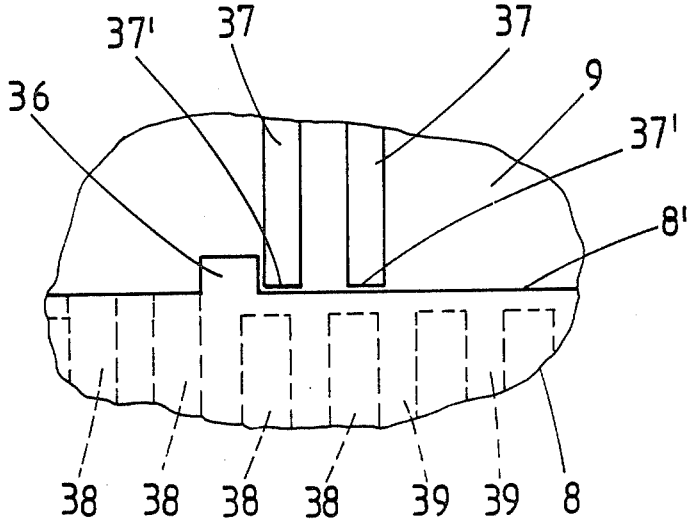
FIG. 6 is a showing corresponding to FIG. 5, but in stop-defined locked position.

As can be noted from FIGS. 3 and 4, only a fraction of the entire grooves 38 produced on the cylindrical surface of the cup 8 are used for the formation of the locking means, namely those which, in the corresponding turn-stop position, lie in front of the ribs 37 of the cap 9 which are arranged in pairs.

In order not to transmit the turning motion of the pump-forming parts to the pump bellows B, a development has been provided such that the central nipple 29 containing the valve body of the cap 9 engages turnably in a collar 40 of the pump bellows B which concentrically surrounds said nipple. The corresponding enclosing takes into consideration, in this case, at the same time the need for a seal between the medium-conducting region of the dosaging pump and the bellows-surrounding annular space which serves for the air equalization.

Figure 11:
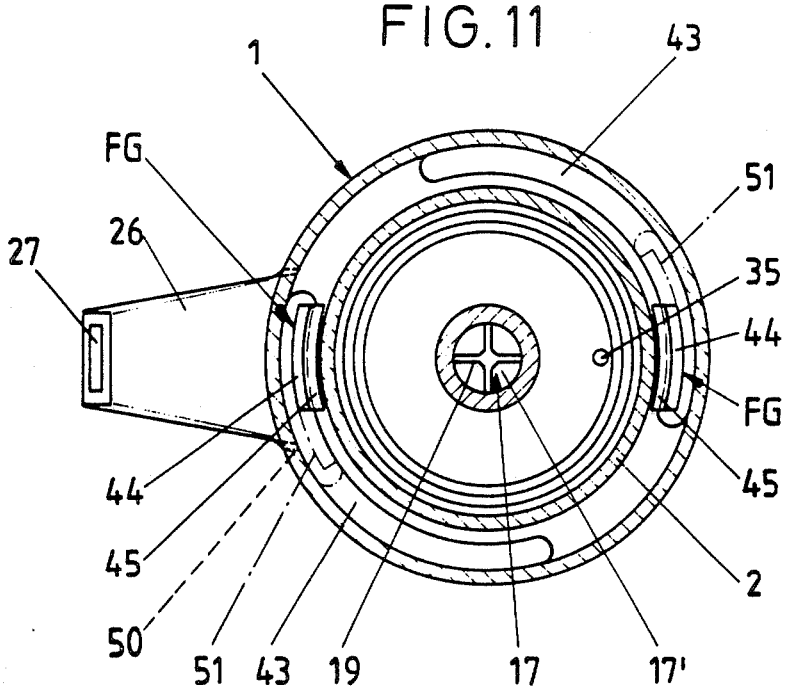
FIG. 11 is a section along the line XI—XI of FIG. 10.

In the second embodiment, the stop-limited angular displacement of the cap is defined by the slots 43 which, as can be noted from FIG. 11, are developed as circular-arc slots. In this connection a displacement range of about 90° is selected, in which end positions the side flanks of the fingers FG strike against one or the other end of the slot 43. In one stop position (FIG. 11 or FIG. 10) the nozzle 26 of the cap 9 which is turnable in the cup 8 lies, in the pump-ready pumpable position, precisely above an entry notch 50 in the cup wall. The outer cross section of the nozzle 26 is adapted to the width of the notch, and the depth thereof is adapted to the stroke x.

Figure 12:
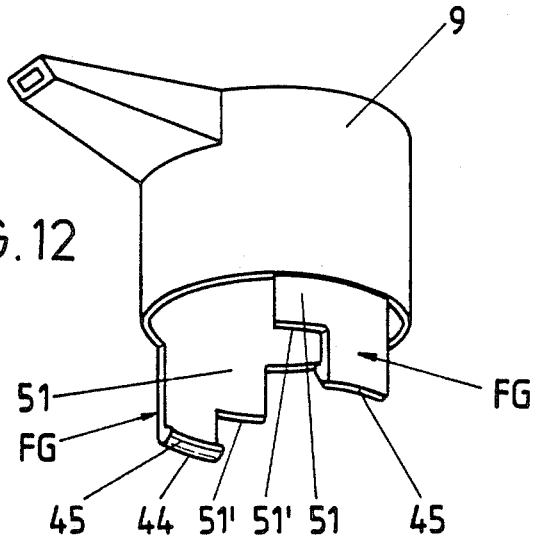
FIG. 12 shows the cap in an individual perspective view, showing a modified locking device.

If the development of a visible entry notch 50 on the cup wall is to be avoided, a development can also be used in which a locking projection 51 extends in the same direction as the fingers FG from the lower edge or end edge 9'' of the side wall of the turnable cap 9. The locking projection 51 can be developed free-standing with respect to the fingers or be a part thereof. Reference is had to FIG. 12 where the locking projections 51 are shown in this manner. In FIG. 11, which covers the above fully explained manner of locking, these locking projections 51 are shown for greater clarity in dot-dash line, although a structurally different development is concerned there. In the pump-ready position, the lower edges 51' of the locking projections 51 which point in the direction towards the bottom 7, lie, in each case, above an opening in the bottom 7; in the locked position, on the other hand, they lie within an angular region in which they strike from above against the bottom 7. The axial setback of the fingers FG which can be noted corresponds to the stroke x. The locking projection 51 which is formed by a broadening in the region of attachment of the fingers FG cooperates with an opening which is formed, in the case of a free-standing locking projection 51 separately, or otherwise from a part of the slots 43, so that no separate openings are necessary. By this broadening of the fingers FG the result is obtained, seen in circumferential direction, of a larger accumulation of material which stabilizes them, the increased arc section also proving favorable.

The operation is as follows:

By exerting a force in the direction of the arrow P on the actuating surface 23, the movable part of the dosaging pump 1, i.e. the cap 9, is displaced in guided manner downwardly, after prior unlocking. The position shown in FIG. 2 is present, in which the volume within the bellows is reduced. The liquid medium 15 present therein is accordingly displaced, passing through the upper valve, with the lifting of the valve-closure member 21 there, and reaching, via the chamber 28, into the nozzle channel 27 for delivery. The pressure produced within the bellows closes the lower valve-closure member 17. If the cap 9 is now released, the pump bellows B, as a result of the restoring force inherent in it, produces the basic position shown in FIG. 1. This leads to a suction stroke. The valve-closure member 17 present in the bottom 7 lifts off from its valve seat surface 18. Via the riser 14 the next dosaged quantity of material is thus drawn into the bellows body. The corresponding suction force, aided by the spring tongues 22, holds the upper valve-closure member 21 in closed position. The volume dispensed is compensated for by air which can penetrate in the manner described above, via the air inlet opening 35, into the bottle. After use, the dosaging pump is again locked by relative twisting motion between cap and cup, in which connection the ribs 37 come out of the region of the continuously open grooves 38 and come with their ends 37' in blocking manner in front of the end wall 8'. In the case also of the second embodiment the dosaging pump 1, after use, can be locked again by relative twisting between cap 9 and cup 8, in which case, however, either the bottom side of the nozzle 26 extends in locking manner over the upper edge of the cup, or else the locking projections 51, leaving the passage region, move to above the top of the bottom 7 blocking it. The frictional force between the two parts 8 and 9 by itself secures this stop-defined basic position completely sufficiently, although detent means, not shown in detail, could also be used here.

The material dispensed may consist of fluid or even pasty material, such as, for instance, toothpaste.

I claim:

1. In a dosaging pump having a pump bellows and two valves, which is adapted to be placed on a container, in particular, bottles and the like, one of the valves being associated with a nozzle and the other with an inlet side, the improvement comprising a cup having a bottom and a surrounding wall, the latter surrounds said pump bellows, a cap engages over said pump bellows, said cap includes a cover, said cap has a side wall, said one valve comprises a nozzle-side valve-closure member which is seated in the cover of said cap, said side wall of said cap being guided on said surrounding wall of said cup, the other valve comprises an inlet-side valve-closure member, the latter being seated within the bottom of said cup, said bottom of said cup is formed with an air-inlet opening, said cup and said cap have collars, end folds of the pump bellows are seated on said separate collars of said cap, and said end folds extend into outwardly directed protruding base support rings, and a cup-bottom side of said base support rings has a sealing lip extending over said air-inlet opening in the cup bottom and said lip has a free-standing lip section resting against an inner wall of said cup.

2. The dosaging pump according to claim 1, further comprising a bottom side of the bottom includes a screw of the dosaging pump, and a riser nipple is located centrally on said bottom side of the bottom, said inlet-side valve-closure member is contained within said nipple.

3. The dosaging pump according to claim 1, wherein said cap has an actuating surface extending axially spaced over the cover of the cap, said nozzle-side valve-closure member has spring tongues protruding as horns resting against a bottom side of said actuating surface of the cap.

4. The dosaging pump according to claim 1, wherein said bottom of said cup is formed with a nipple hole which receives said inlet-side valve-closure member, means comprising retaining projections on said cup bottom adjacent an upper edge of said nipple hole for retaining said inlet-side valve-closure member.

5. The dosaging pump according to claim 1, wherein the cup-bottom side base support ring terminates spaced axialy in front of the air-inlet opening.

6. The dosaging pump according to claim 1, wherein the pump bellows is formed as a threaded bellows.

7. The dosaging pump according to claim 1, wherein said cup and cap are turnable with respect to each other in an expanded position of the pump bellows into one turn-stop position and another turn-stop position, said cap is formed with ribs and said cup is formed with projections, said turn-stop positions are defined by said projections abutting side flanks of said ribs.

8. The dosaging pump according to claim 1, further comprising a plurality of pairs of ribs arranged with angular symmetry on the inner surface of the side wall of said cap.

9. The dosaging pump according to claim 1, wherein said surrounding wall of said cup has a cylindrical surface, an inner surface of the side wall of said cap is guided on said cylindrical surface of the cup.

10. The dosaging pump according to claim 9, wherein said cover of said cap has a central nipple, said one valve is disposed in said central nipple, said pump bellows is formed with a collar, the cap, via said central nipple, engages turnably into said collar of the pump bellows.

11. The dosaging pump according to claim 9, wherein said cup and cap are turnable with respect to each other in an expanded position of the pump bellows into one turn-stop position and another turn-stop position, and the cylindrical surface of the cup has first ribs defining first grooves therebetween, said inner surface of the cap has second ribs, in said one turn-stop position of the cap relative to said cup said first grooves are aligned with said second ribs on the cap, and in said another turn-stop position said second ribs are aligned with the first ribs of the cylindrical surface of the cup.

12. The dosaging according to claim 11, wherein said first ribs and said first grooves therebetween are on the cylindrical surface of the cup, uniformly distributed over its entire circumference, only a fraction of said first ribs and grooves therebetween lie in front of the second ribs of the cap in said one turn-stop position, said fraction of said first ribs and grooves therebetween are open in a longitudinal direction towards the top.

* * * * *